US009188320B2

(12) United States Patent
Russello et al.

(10) Patent No.: US 9,188,320 B2
(45) Date of Patent: Nov. 17, 2015

(54) LUMINAIRE JUNCTION BOX

(75) Inventors: Thomas Russello, Freehold, NJ (US); Dylan Akinrele, Leonia, NJ (US); Frank Locascio, Howell, NJ (US)

(73) Assignee: GENLYTE THOMAS GROUP, LLC, Louisville, KY (US)

( * ) Notice: Subject to any disclaimer, the term of this patent is extended or adjusted under 35 U.S.C. 154(b) by 1624 days.

(21) Appl. No.: 11/866,124

(22) Filed: Oct. 2, 2007

(65) Prior Publication Data

US 2008/0094838 A1 Apr. 24, 2008

Related U.S. Application Data

(60) Provisional application No. 60/828,721, filed on Oct. 9, 2006.

(51) Int. Cl.

| | |
|---|---|
| ***F21V 17/02*** | (2006.01) |
| ***F21V 21/30*** | (2006.01) |
| ***F21V 23/04*** | (2006.01) |
| *F21S 8/00* | (2006.01) |
| *F21W 131/10* | (2006.01) |

(52) U.S. Cl.

CPC ..... *F21V 21/30* (2013.01); *F21V 23/0442* (2013.01); *F21S 8/033* (2013.01); *F21W 2131/10* (2013.01)

(58) Field of Classification Search

CPC ..... F16C 11/00; F16C 11/04; F21V 21/26; F21V 21/30; F21V 21/14; F21V 23/0442; F16M 11/10; F16M 11/12; F21S 8/04; F21S 8/043; F21S 8/046; F21S 8/033; F21W 2131/10

USPC ..... 362/250, 249.1, 371, 727, 418, 427, 362/428, 430, 432, 147, 236, 239, 249.03, 362/249.09, 249.11, 269, 275, 285, 287; 403/104, 106, 107

See application file for complete search history.

(56) References Cited

U.S. PATENT DOCUMENTS

| | | | |
|---|---|---|---|
| 1,045,852 | A | 12/1912 | Jones |
| D51,774 | S | 2/1918 | Coppinger |
| 1,357,539 | A | 11/1920 | Bissell |
| 1,388,221 | A | 8/1921 | Toepfer |
| 1,539,131 | A | 5/1925 | McCarley |
| 1,633,837 | A | 6/1927 | Youtz |
| 1,702,746 | A | 2/1929 | Prichard |
| 2,080,120 | A | 5/1937 | Everett |
| 2,166,394 | A | 7/1939 | Crossley |
| 2,288,166 | A | 6/1942 | Kucher |
| 2,313,131 | A | 3/1943 | Elias |
| 2,545,163 | A | 3/1951 | Naster |
| 2,687,867 | A | 8/1954 | Wolar |
| 2,758,199 | A | 8/1956 | Yonkers |
| 2,836,709 | A | 5/1958 | Van Dusen, Jr. |
| 2,852,663 | A | 9/1958 | Stuffer et al. |

(Continued)

*Primary Examiner* — Mary McManmon

(57) ABSTRACT

A residential outdoor luminaire having a combined junction box and mounting arm that allows for canopy mounting as well as mounting on a vertical surface is provided. The luminaire housing has a rear beveled mount surface which engages a junction box mounting arm. The junction box mounting arm has at least one side wall and a hollow interior with an outwardly extending mounting flange. The sidewall has a beveled mounting face engageable with the rear bevel mount surface of the luminaire such that the junction box mounting arm may be mounted against a vertical or horizontal surface while maintaining the luminaire in a similar orientation with respect to the area being illuminated.

20 Claims, 14 Drawing Sheets

(56) References Cited

U.S. PATENT DOCUMENTS 2,960,361 A 11/1960 Boutelle
2,971,737 A 2/1961 Parker
2,973,895 A 3/1961 Brown et al.
3,040,994 A 6/1962 Anderson et al.
3,078,366 A 2/1963 Winkler
3,082,987 A 3/1963 Robinson
3,096,029 A 7/1963 Berge
3,154,704 A 10/1964 Shaffer
3,202,070 A 8/1965 Pratt, Jr. et al.
3,299,200 A 1/1967 Sulzer
3,299,265 A 1/1967 Rackley et al.
3,299,591 A 1/1967 Woelk
3,319,203 A 5/1967 Haughney
3,347,008 A 10/1967 Strengholt
3,388,246 A 6/1968 Bailey
3,413,462 A 11/1968 Spero
3,433,449 A 3/1969 Musante
3,461,283 A 8/1969 Hahn
3,479,081 A 11/1969 Schaaf
3,505,515 A 4/1970 Adra
3,529,148 A 9/1970 Stefano et al.
3,541,478 A 11/1970 Peterson et al.
3,543,016 A 11/1970 Jones
3,604,916 A 9/1971 Adra et al.
3,701,898 A 10/1972 McNamara, Jr.
3,711,702 A 1/1973 Adra
3,754,724 A 8/1973 Osowski
3,778,610 A 12/1973 Wolf
3,852,588 A 12/1974 Crawford
3,940,898 A 3/1976 Kaufman
3,990,201 A 11/1976 Falbel
3,991,905 A 11/1976 Nicpon
4,000,406 A 12/1976 Bhavsar
4,001,778 A 1/1977 Ross
4,015,394 A 4/1977 Kessler
4,027,151 A 5/1977 Barthel
4,029,630 A 6/1977 Meinhold et al.
4,090,210 A 5/1978 Wehling et al.
4,091,444 A 5/1978 Mori
4,112,483 A 9/1978 Small, Jr. et al.
4,141,061 A 2/1979 Ford et al.
4,143,412 A 3/1979 Sassmannshausen
4,143,413 A 3/1979 Kelly
4,155,111 A 5/1979 Kelly et al.
4,164,784 A 8/1979 Jaksich
4,173,037 A 10/1979 Henderson, Jr. et al.
4,212,050 A 7/1980 Trenkler
4,213,170 A 7/1980 Kimball et al.
4,218,727 A 8/1980 Shemitz et al.
4,229,782 A 10/1980 Ruud et al.
4,240,853 A 12/1980 Pustka
4,242,725 A 12/1980 Douma et al.
4,254,456 A 3/1981 Grindle et al.
4,261,030 A 4/1981 Hernandez
4,293,901 A 10/1981 Hernandez
4,310,876 A 1/1982 Small, Jr. et al.
4,318,237 A 3/1982 Hicks
4,319,313 A 3/1982 Eberhart et al.
4,323,954 A 4/1982 Florence et al.
4,323,956 A 4/1982 Pustka
4,333,131 A 6/1982 Hujimoto et al.
4,337,507 A 6/1982 Lasker
4,364,108 A 12/1982 Rapp
4,395,750 A 7/1983 Scheidemann et al.
4,403,278 A 9/1983 Flood
4,414,616 A 11/1983 de Vos et al.
4,422,135 A 12/1983 McCamy
4,447,863 A 5/1984 Fenne
4,449,168 A 5/1984 Ewing
4,450,660 A 5/1984 Dean et al.
4,459,648 A 7/1984 Ullman
4,459,789 A 7/1984 Ford
4,460,948 A 7/1984 Malola
4,471,411 A 9/1984 Graham et al.
4,473,873 A 9/1984 Quiogue
4,480,809 A 11/1984 Healey
4,527,224 A 7/1985 Sangiamo et al.
4,531,180 A 7/1985 Hernandez
4,546,420 A 10/1985 Wheeler et al.
4,590,544 A 5/1986 Decandia
4,602,320 A 7/1986 Tomkin et al.
4,623,956 A 11/1986 Conti
4,626,975 A 12/1986 Miletich
4,709,890 A 12/1987 Moore
4,717,991 A 1/1988 Murphree, Jr.
4,760,511 A 7/1988 Russello et al.
4,766,709 A 8/1988 Galbraith
4,786,344 A 11/1988 Beuther
4,794,501 A 12/1988 Bartenbach
4,816,969 A 3/1989 Miller
4,864,078 A * 9/1989 Bowman ..... 174/486
4,893,224 A 1/1990 Tinley
4,970,634 A 11/1990 Howell et al.
5,016,150 A 5/1991 Gordin et al.
5,055,987 A * 10/1991 Ellson et al. ..... 362/277
5,062,029 A 10/1991 Engel
5,068,769 A 11/1991 Umeda et al.
5,081,569 A 1/1992 Quiogue et al.
5,099,405 A 3/1992 Gehly et al.
5,111,371 A 5/1992 Nielson
5,140,507 A 8/1992 Harwood
5,160,201 A * 11/1992 Wrobel ..... 362/249.03
5,183,331 A 2/1993 Edgell et al.
5,249,110 A 9/1993 Russello et al.
5,258,899 A * 11/1993 Chen ..... 362/394
5,278,737 A 1/1994 Luce et al.
5,289,358 A 2/1994 Halemeier
5,307,254 A 4/1994 Russello et al.
5,323,995 A 6/1994 Grittman et al.
D348,745 S 7/1994 Ewing et al.
5,339,234 A 8/1994 Russello et al.
5,377,087 A 12/1994 Yoon
5,404,297 A 4/1995 Birk et al.
5,435,087 A 7/1995 Karkar et al.
5,442,132 A 8/1995 Sandell et al.
5,446,637 A 8/1995 Cunningham et al.
5,450,303 A 9/1995 Markiewicz et al.
5,469,761 A * 11/1995 Laue ..... 74/579 R
D370,228 S 5/1996 Chapman et al.
5,572,819 A 11/1996 Topinka et al.
5,613,766 A 3/1997 Raouf
5,642,934 A 7/1997 Haddad
5,647,659 A 7/1997 Mori
5,662,411 A 9/1997 Haslam
5,690,419 A 11/1997 Siems
5,704,710 A 1/1998 Greene et al.
D390,994 S 2/1998 Ewing et al.
D390,995 S 2/1998 Ewing et al.
D391,383 S 2/1998 Ewing et al.
5,722,770 A 3/1998 Douglas
5,743,632 A 4/1998 Carl
5,803,585 A 9/1998 Littman et al.
D400,277 S 10/1998 Ewing et al.
5,826,975 A 10/1998 Hsieh et al.
5,906,431 A 5/1999 Chianale et al.
5,941,630 A * 8/1999 Finke et al. ..... 362/371
6,017,131 A 1/2000 Goins
D424,736 S 5/2000 Johnson
6,059,424 A 5/2000 Kotloff
6,116,564 A 9/2000 Cates
6,174,071 B1 * 1/2001 Chan ..... 362/187
6,290,376 B1 9/2001 Gutierrez et al.
6,293,676 B1 * 9/2001 Holway ..... 352/243
6,375,141 B1 4/2002 Kettlestrings
6,402,352 B1 6/2002 Summerford et al.
6,450,657 B1 9/2002 Testa et al.
D469,565 S 1/2003 Anderson et al.
6,517,216 B1 2/2003 Cercone et al.
6,530,681 B2 3/2003 Sieczkowski
6,607,292 B2 8/2003 Gutierrez et al.
6,733,158 B2 5/2004 Fischer et al.
6,781,129 B2 * 8/2004 Leen ..... 250/342
6,840,658 B2 1/2005 Anderson et al.
6,848,806 B2 2/2005 Yoshida et al.

(56) References Cited

U.S. PATENT DOCUMENTS

| | | | | |
|---|---|---|---|---|
| 6,892,991 | B1 * | 5/2005 | Soh | 248/188.2 |
| 6,905,222 | B1 | 6/2005 | Russello et al. | |
| 7,059,747 | B2 | 6/2006 | Barozzini et al. | |
| 7,090,382 | B2 | 8/2006 | Haddad et al. | |
| 7,121,684 | B2 | 10/2006 | Barozzini et al. | |
| 7,150,542 | B1 | 12/2006 | Russello et al. | |
| 7,543,958 | B2 * | 6/2009 | Chi et al. | 362/276 |
| 7,559,677 | B1 * | 7/2009 | Dupre | 362/287 |
| 7,832,889 | B1 * | 11/2010 | Cogliano | 362/147 |
| 2002/0075960 | A1 * | 6/2002 | Chen | 375/240.18 |
| 2004/0090781 | A1 * | 5/2004 | Yeoh | 362/287 |
| 2005/0117333 | A1 | 6/2005 | Yoshida et al. | |
| 2006/0262544 | A1 * | 11/2006 | Piepgras et al. | 362/373 |
| 2007/0297169 | A1 * | 12/2007 | Holmes | 362/227 |

* cited by examiner

LUMINAIRE JUNCTION BOX

CROSS-REFERENCE TO RELATED APPLICATION

This application, under 35 USC §119(e), claims priority to and benefit from U.S. Provisional Application Ser. No. 60/828,721, filed in the United States Patent and Trademark Office on Oct. 9, 2006, entitled, "Outdoor Luminaire."

FIELD OF THE INVENTION

The present invention relates generally to a lighting fixture, and more particularly, to an outdoor luminaire assembly which can be adapted for use in different configurations.

BRIEF DESCRIPTION OF THE DRAWING FIGURES

DETAILED DESCRIPTION OF THE EMBODIMENTS

Figure 1:
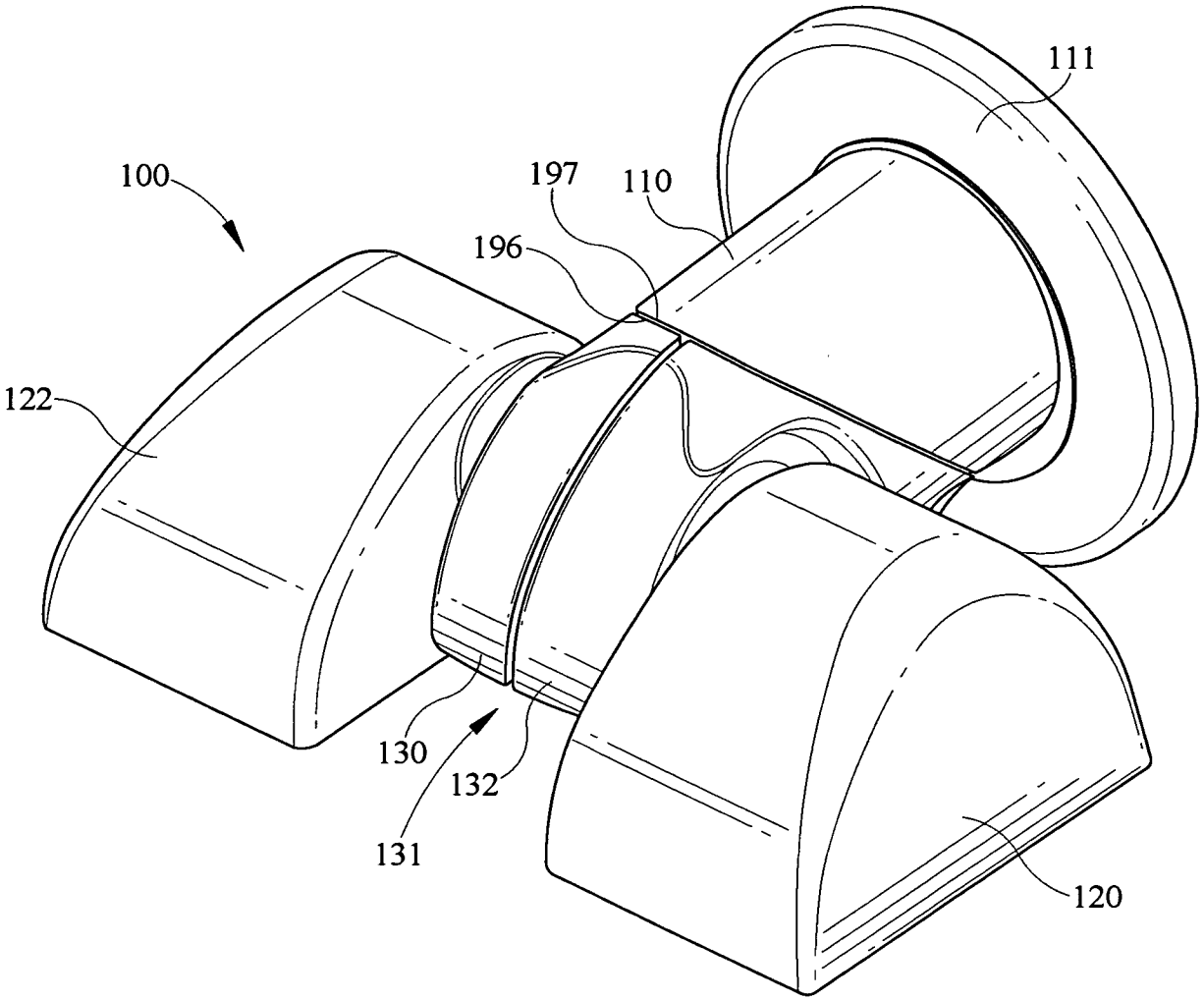
FIG. 1 is top perspective view of a luminaire and mounting arm in accordance with one embodiment of the present invention showing it in a position for mounting on a vertical surface.

Referring now to the Figures and in accordance with an embodiment of the present invention, luminaire 100 is shown and described. In FIG. 1, luminaire 100 is shown engaged with multiposition mounting arm 110 in a position for mounting on a vertical surface such as a wall. Luminaire 100 has a right illumination head 120 rotatably engaged with a right housing component 132 and a left illumination head 122 rotatably engaged with a left housing component 130. Right and left housing components 132 and 130 engage to form a support housing having rear angled or beveled mount surface 196. The support housing 131 may be multi-part or may be unitary. Mounting arm 110, in this embodiment, has a hollow interior which optionally forms a junction box between a flat mounting surface and the support housing formed with housing 131. Combined junction box mounting arm 110 has an outwardly radial extending mounting flange or surface mounting face 111 for receiving a mounting plate which engages the mounting surface. The hollow interior of mounting arm junction box 110 is formed by at least one mounting arm sidewall and is sufficient in size to act as a junction box to connect electrical wires from luminaire 100 to electrical power supply wires extending from the mounting surface into mounting arm junction box 110. In the embodiment shown, the side wall of mounting arm 110 is tubular with beveled mounting face or angled mount surface 197 engaged with rear bevel mount surface 196 of housing 131 of luminaire 100 in an orientation such that junction box mounting arm 110 is mountable against a vertical surface. The tubular sidewall of combined junction box and mounting arm 110 has a long side oriented on an upper surface and a short side oriented on a lower surface creating side beveled mounting face 197. Beveled mounting face 197 preferably is about 45° relative to a substantially vertical plane defined by mounting flange 111.

Figure 2:
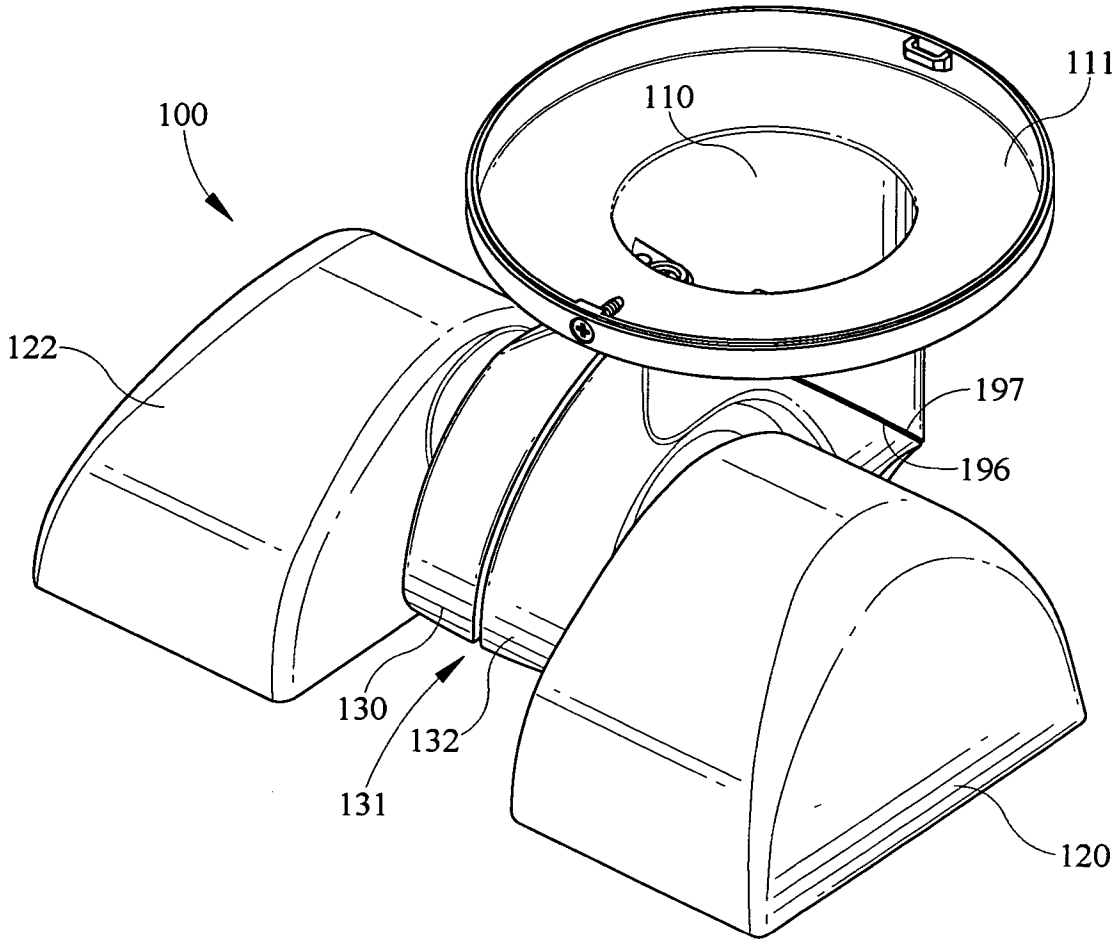
FIG. 2 is top perspective view of the luminaire and mounting arm of FIG. 1 showing it in a position for mounting on a horizontal surface.

In FIG. 2, luminaire 100 is shown engaged with multiposition mounting arm 110 in a position for mounting on a horizontal surface, such as a canopy mount. Luminaire 100 has a right illumination head 120 rotatably engaged with a right housing component 132 and a left illumination head 122 rotatably engaged with a left housing component 130. Housing components 132 and 130 engage to form a support housing 131 having rear beveled mount surface 196. Combined junction box mounting arm 110 has surface mounting flange 111 horizontally positioned with beveled mounting face or angled mount surface 197 engaged with rear bevel mount surface 196 of luminaire 100 in an orientation such that junction box mounting arm 110 is in a position for mounting against a horizontal surface. The tubular sidewall of combined junction box and mounting arm 110 has a long side oriented on a surface opposite luminaire 100 and a short side oriented on a surface proximate luminaire 100 creating side beveled mounting face 197. Beveled mounting face 197 is about 45° relative to a plane defined by mounting flange 111.

Figure 3:
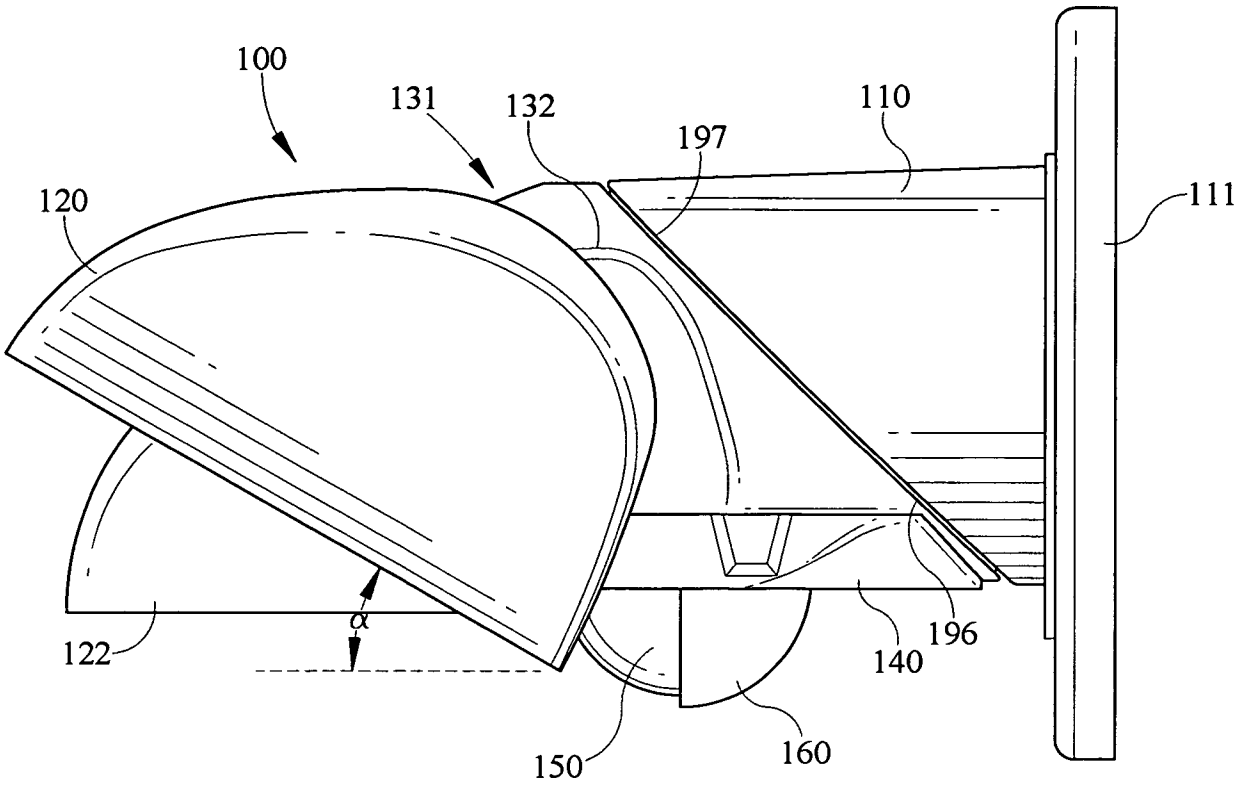
FIG. 3 is a side view of the luminaire and mounting arm of FIG. 1 showing an adjustable illumination head in a forward rotated position.

FIG. 3 shows luminaire 100 in a substantially horizontal orientation with adjustable illumination heads 120 and 122 and the orientation of motion sensor lens 150 about luminaire 100. Luminaire 100 is shown engaged with multiposition mounting arm 110 in a position for mounting on a vertical surface. Luminaire 100 has a right illumination head 120 engaged with the support housing 131 and a left illumination head 122 engaged with the support housing 131. Right illumination head 120 is shown rotated outwardly away from mounting flange 111 at an angle $\alpha$ in relation to a horizontal surface below or in relation to a plane normal to the mounting surface. In one embodiment, angle $\alpha$ is between about −10° and 30° (shown in FIG. 3). It is to be understood that angle $\alpha$ may have any degree range, even 360°. Left illumination head 122 is adjustable independently of right illumination head 120 and is shown pointed downward with an angle $\alpha$ of 0°. Also shown here is motion sensor lens 150 having diffuser 160 covering an outer portion thereof. Control cover 140 covers a lower opening of the support housing 131 formed with combined components 130 and 132 where motion sensor lens 150 downwardly depends. Diffuser 160 allows directional control of sensor lens 150 by permitting a user to cover a portion of sensor lens 150 thereby eliminating an area from the view of sensor lens 150.

Figure 4:
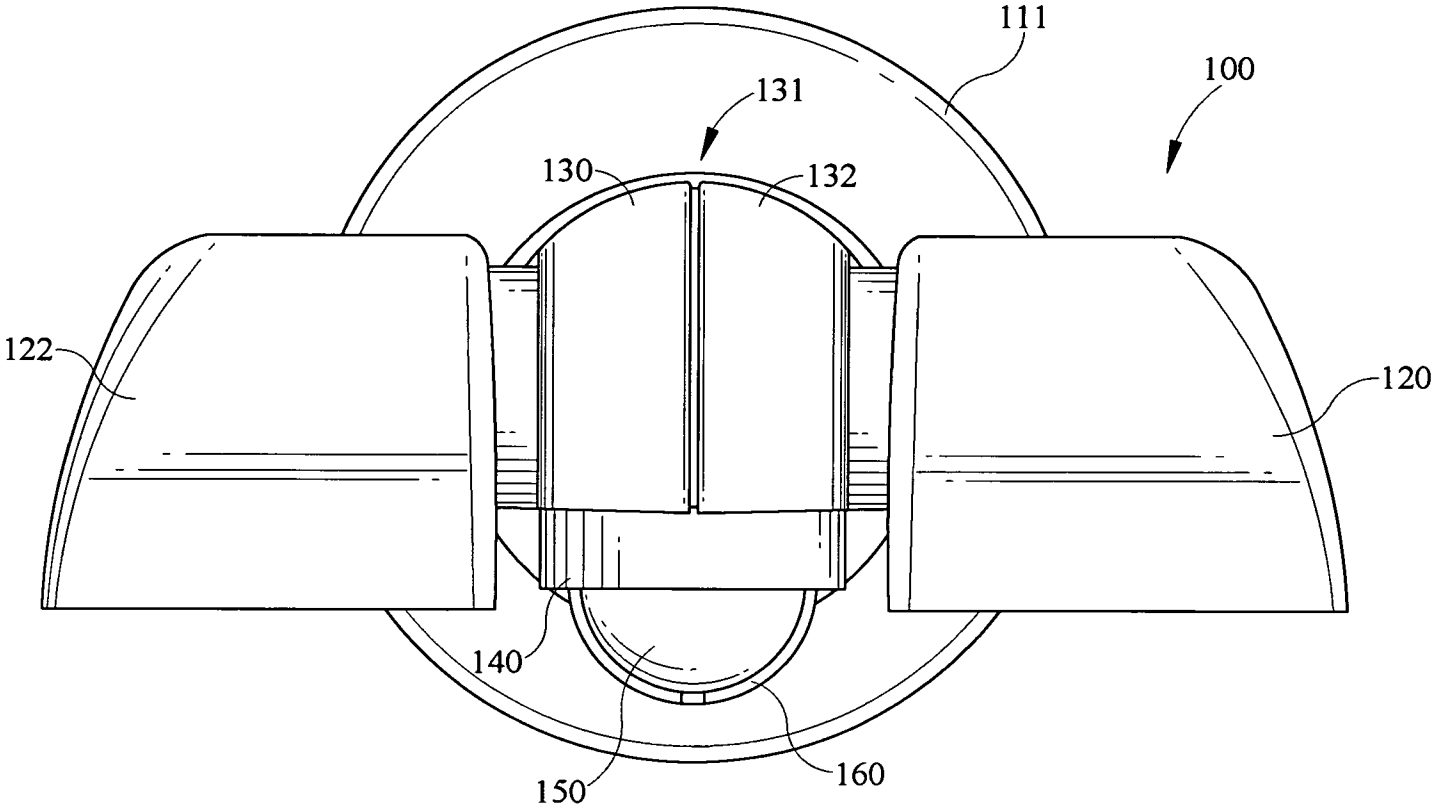
FIG. 4 is a front view of the luminaire and mounting arm of FIG. 1 showing a diffuser for adjusting a motion sensor lens.

FIG. 4 shows a front view of luminaire 100 engaged with multiposition mounting arm 110 having mounting flange 111 in a position for mounting on a vertical surface. Luminaire 100 has a right illumination head 120 engaged with a right housing component 132 and a left illumination head 122 engaged with a left housing component 130 which are combined to form a support housing 131. Both, right illumination head 120 and left illumination 122 are shown rotated toward a downward position, i.e. $\alpha=0°$. Motion sensor lens 150 has diffuser 160 covering an outer right portion thereof. Motion sensor lens diffuser 160 is optional as having motion sensor lens 150 completely exposed enables the sensing of motion 360° about the luminaire. In the embodiment shown, diffuser 160 covers a right half of motion sensor lens 150 thus eliminating the sensing of motion to the right of luminaire 100. It is to be understood that diffuser 160 can have any configuration or placement about sensor lens 150 to block the sensing of motion in any direction relative to luminaire 100. Typically, when motion is sensed by the sensor typically a PIR sensor located within housing 131 adjacent lens 150, luminaire 100 is switched on and it is therefore advantageous to shield the sensing of traffic or blowing trees from sensor lens 150. Control cover 140 covers a lower opening in the housing formed with components 130 and 132 where motion sensor lens downwardly depends therethrough.

Figure 5:
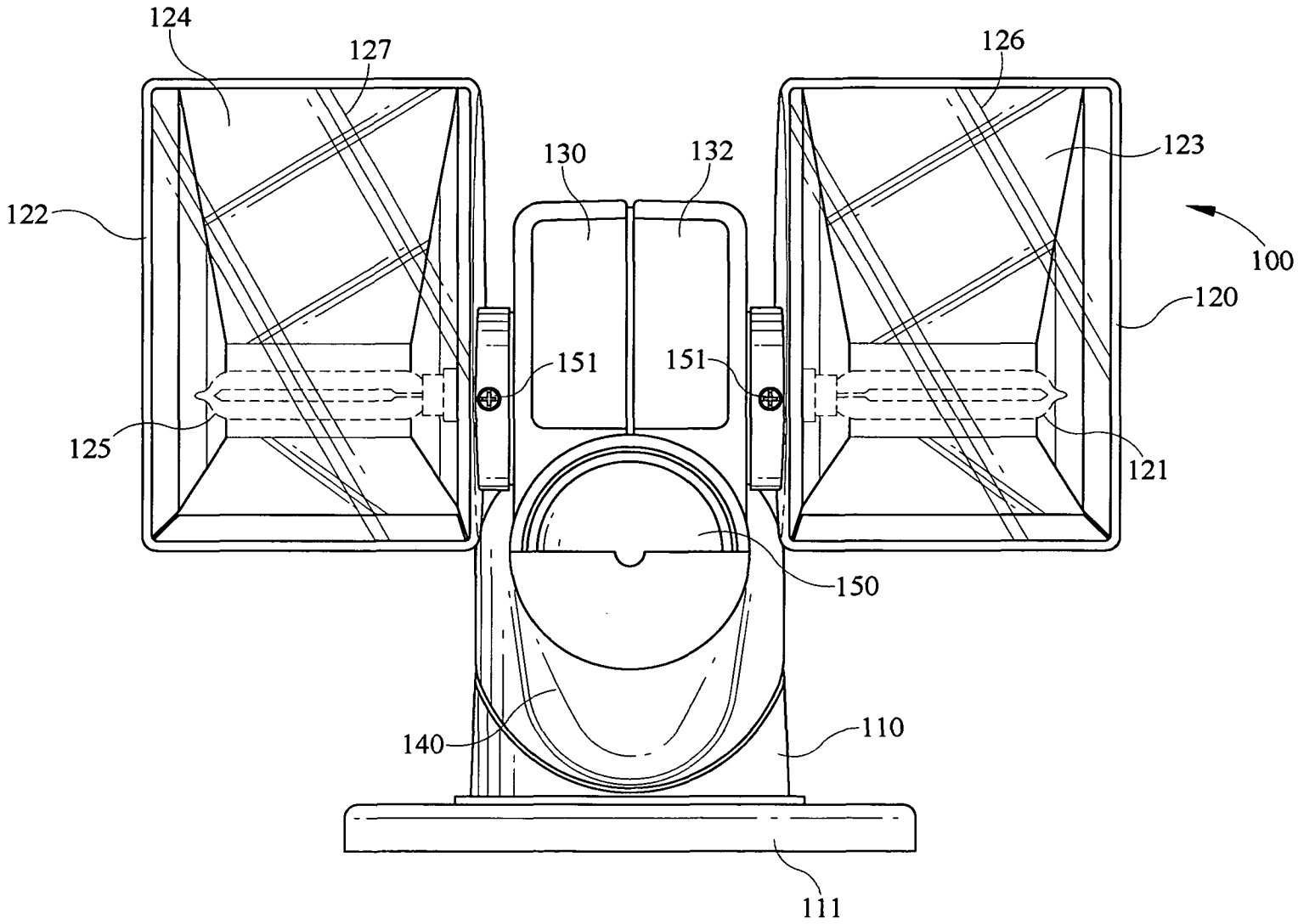
FIG. 5 is a bottom view of the luminaire and mounting arm of FIG. 1 showing the position of lamps in the illumination heads and lenses thereon.

FIG. 5 shows lamps 121 and 125 within illumination heads 120 and 122 respectively. Luminaire 100 is configured for mounting on a vertical surface with mounting flange 111 having mounting arm 110 depending therefrom. Control cover 140 is shown covering the housing proximate mounting flange 111. Depending through control cover 140 is motion sensor lens 150. Motion sensor lens 150 houses a sensor and is shown here without diffuser 160, providing 360° sensing capability. Any type of sensor will suffice and one of skill in the art will understand that various structures are available for use as a sensor described and claimed herein. Extending outward from right housing component 132 is right illumination head 120. Lamp 121 extends into right illumination head 120 from a lamp socket in housing component 132. Illumination head 120 has right reflector 123 covering the inner surface thereof and lens 126 covering a lower opening thereof. The illumination head is placed at 0° providing full cutoff lighting. Extending outward from left housing component 130 is left illumination head 122. Lamp 125 extends into left illumination head 122 from a lamp socket in housing component 130. Illumination head 122 has left reflector 124 covering the inner surface thereof and lens 127 covering a lower opening thereof. Similarly, head 122 is positioned at 0° providing full cutoff lighting.

Figure 6:
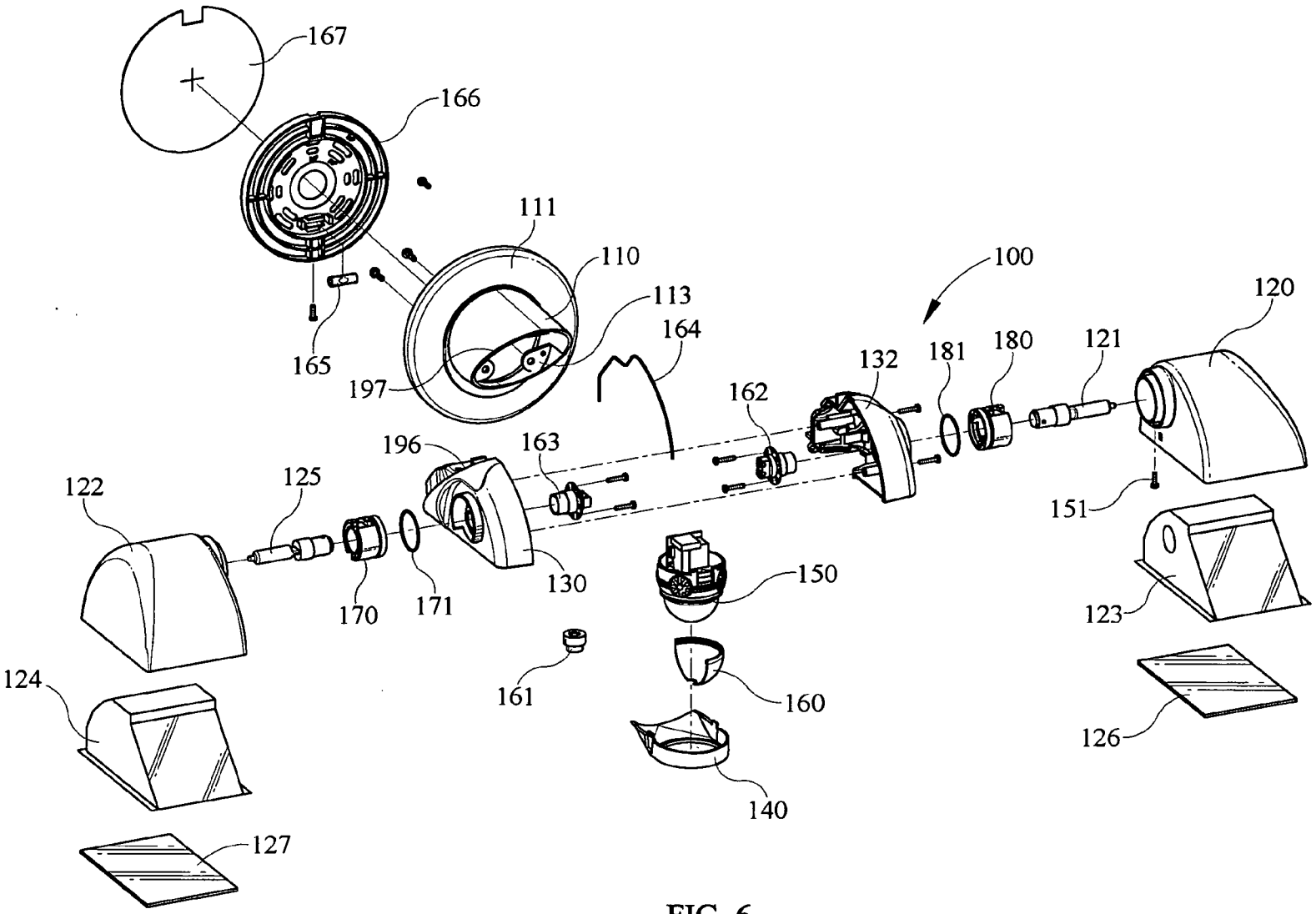
FIG. 6 is an exploded view of the luminaire and mounting arm of FIG. 1 showing the internal and external components thereof and their cooperation therebetween.

FIG. 6 shows an exploded view of luminaire 100 and mounting arm 110 showing the internal and external components thereof and their cooperation therebetween. Mounting gasket 167 covers a rear surface of mounting plate 166, both of which are fastened to a mounting surface. Bubble level 165 on an outer surface of mounting plate 166 provides for a visual indication of level mounting of mounting plate 166 on a mounting surface. Mounting flange 111 mounts onto mounting plate 166 and has mounting arm 110 extending therefrom. Extending inward from the sidewall of mounting arm 110 is a pair of inwardly extending fastening tabs 113 for removable affixation of rear beveled mount surface 196 onto beveled mounting face or angled mount surface 197 on mounting arm 110. Right and left housing components 132 and 130 removably affix with gasket 164 therebetween forming substantially sealed luminaire support housing 131. Of course, the housing can be of any desired construction, unitary assembly or other structure. Extending outwardly through right housing component 132 is lamp socket 162 and extending outwardly through left housing component 130 is lamp socket 163. Positioned about right lamp socket 162 is pivot barrel 180 having o-ring gasket 181 therearound for sealing with right illumination head 120. Positioned about left lamp socket 163 is pivot barrel 170 having o-ring gasket 171 therearound for sealing with left illumination head 122. Right lamp 121 removably attaches in lamp socket 162 and extends through pivot barrel 180 into right illumination head 120. Right illumination head 120 pivotally attaches to pivot barrel 180 and surrounds a portion of lamp 121. Reflector 123 mounts within right illumination head 120 and covers the internal side thereof. Lens 126 mounts within a lower edge of right illumination head 120 proximate the outer edge of reflector 123 making right illumination head 120 full cutoff, i.e. intensity does not exceed zero candela at or above an angle of 90° above nadir and maximum candela does not exceed 10% of rated lumens at a vertical angle of 80°-90° above nadir, when rotated in a downward projection ($\alpha=0°$, FIG. 3). Left lamp 125 removably attaches in lamp socket 163 and extends through pivot barrel 170 into left illumination head 122. Left illumination head 122 pivotally attaches to pivot barrel 170 and surrounds a portion of lamp 125. Reflector 124 mounts within left illumination head 122 and covers the internal side thereof. Lens 127 mounts within a lower edge of left illumination head 122 proximate the outer edge of reflector 124 making left illumination head 122 full cutoff.

Figure 7:
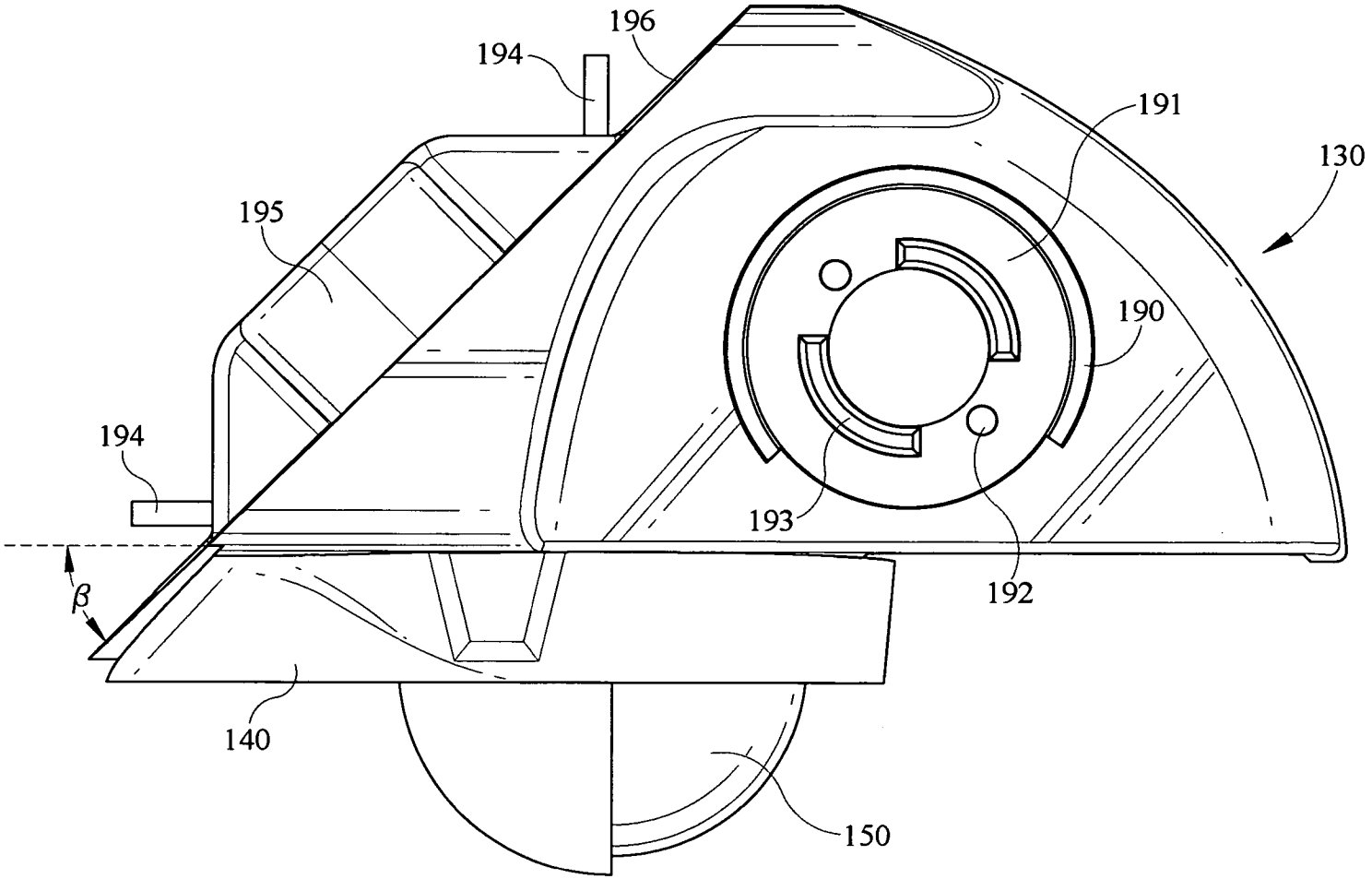
FIG. 7 is a side view of a housing of the luminaire of FIG. 1 showing features for cooperating with a support arm and a pivot barrel.

FIG. 7 is a side view of left housing component 130 showing features for cooperating with support arm 110 and a pivot barrel 170. Right housing component 132 is a mirror image of left housing component 130 and has similarly designated components thereof. Left housing component 130 has outer partial cylindrical extension 190 extending outwardly which is received within a groove between two concentric cylindrical extensions extending outwardly from left illumination head 122. Left illumination head 122 is a mirror image of right illumination head 120 and hence has similarly situated concentric cylindrical extensions with similar designations.

Opposing alignment structures 193 are provided to properly align pivot barrel 170 against the housing 130 in order to properly position the lamp housing at −10° for installation, as will be discussed herein. In general, the design of the housing 131, pivot barrels 170, 180 and lamp heads 120, 122 is such as to allow two different installation angles for heads 120, 122 depending on the orientation of installation of the barrels 170, 180. Barrels 170, 180 are designed with two rotation channels 220 and 224, each of different arc length (see FIGS. 10-11). Each channel has an entry channel 201 allowing lamp head pivot tab 202 to enter into the rotation channel. Tabs 212 of barrels co-act with tabs 193 on support housing such that upon installation of the pivot barrel into the cylindrical extension 190 and mounting surface, entry channel 201 is positioned at about −10° thus requiring the lamp head to be axially installed over the pivot barrel at −10°, then rotate clockwise by a maximum amount defined by the length of the channel and the end wall or surface thereof. Thus, for installation, tab 202 of the right lamp head enters entry channel 201 such that lamp head is at −10° from horizontal and then rotated clockwise depending upon the arc length of the channel 224. With channel 220 installed facing upwards, tab 202 can rotate forward to place lamp at 0° thus allowing rotation of 10°, from −10° to 0°. No further forward rotation would be allowed thus limiting the lamp to a cut-off position. Channel 224 would allow further rotation if installed upwards allowing a desired forward rotation to position the lamp at forward throw of about 30°, dictated by the length of channel 224. Of course, many other orientations and structures of the channels and end surfaces are configurable as can be understood including a single entry channel with no forward rotation to place the lamp head at 0 degrees thus installing at 0 degrees instead of at −10 degrees.

Figure 8:
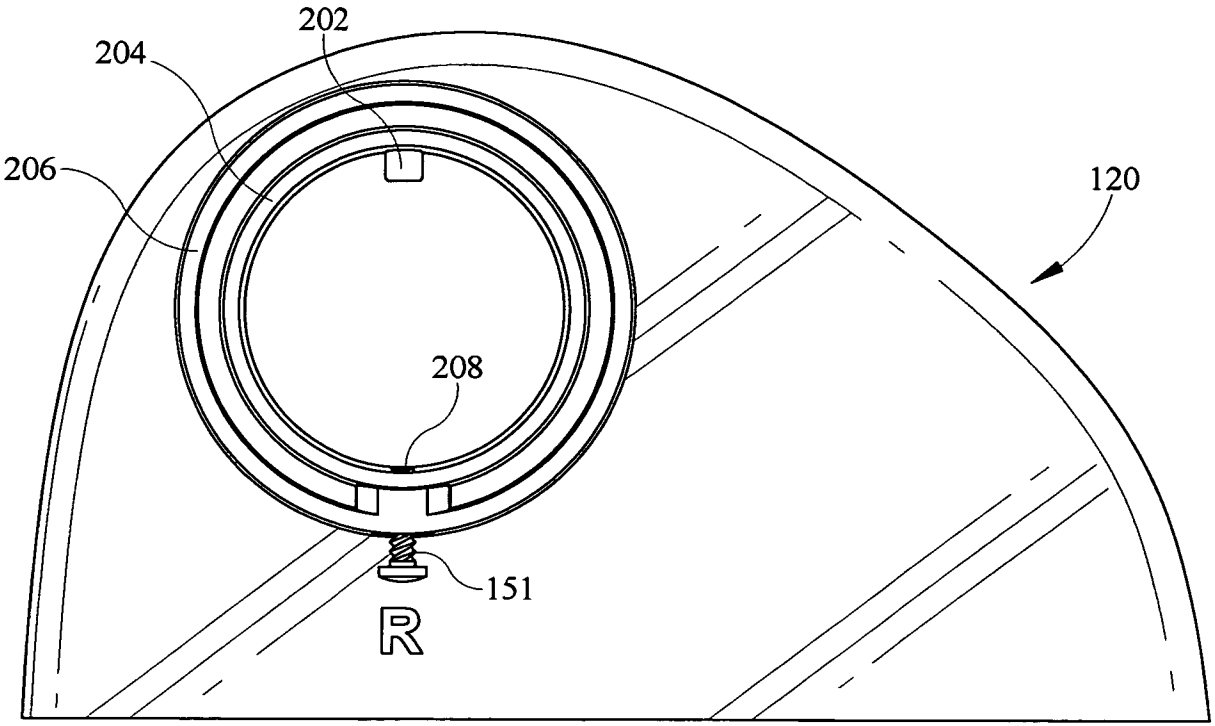
FIG. 8 is a side view of an illumination head of the luminaire of FIG. 1 showing features for cooperating with a pivot barrel.

FIG. 8 shows two concentric cylindrical extensions 204 and 206 extending outwardly from right illumination head 120. Left illumination head 122 has similarly situated concentric cylindrical extensions cooperating with outer partial cylindrical extension 190. Concentrically located within outer partial cylindrical extension 190 is pivot barrel mounting surface 191 having a pair of equidistantly spaced partial cylindrical extensions 193 extending outwardly having fastener receptacles 192 positioned between side edges of each partial cylindrical extension 193. Partial cylindrical extensions 193 and fastener receptacles 192 permit the non-rotational removable attachment of pivot barrel 170 to the support housing 131. Rear beveled mount surface 196 has an angle of β with the lower horizontal surface of housing 131. Preferably, β is about 45° allowing attachment to arm mount 110 for dual surface installation on a horizontal or vertical surface. Dual surface installation is accomplished with the attachment of rear beveled mount surface 196 to arm mount 110 oriented for installation on a horizontal surface and attachment to arm mount 110 oriented for installation on a vertical surface. Rear beveled mount surface 196 has a bump out portion 195 for providing room within support housing 131 for the containment of the electronics and wiring associated with the motion sensor and lamp sockets 162 and 163. Mounting tabs 194 project from rear beveled mount surface 196 for engagement with an aligning tab in arm mount 110. One tab 194 engages an aligning tab in arm mount 110 when luminaire 100 is installed onto arm mount 110 for mounting on a vertical surface and the other tab 194 engages the aligning tab in arm mount 110 when luminaire 100 is installed onto arm mount 110 for mounting on a horizontal surface. Of course, many different types of rotatable interfaces are available for use between the lamp heads and the lamp housing which would restrict forward rotation, for example rotation outward away from a vertical surface on which the luminaire is mounted. Such restrictable and rotatable mounting structures can be comprised of many different instruments but it is desirable to limit forward rotation in a first installed position to keep the luminaire at a cut-off zero degrees while allowing for a second installed position of the rotatable mounting structure between the lamp head and the luminaire to provide positive forward rotation greater than zero degrees. Restrictable rotational mechanisms may be utilized between the lamp head and the housing. Preferably, as shown in one of the embodiments, installation and positioning of the lamp heads is restricted to about 0 degrees in one installed orientation and to greater than 0 degrees in an alternative installed orientation of the rotation mechanism interface between the lamp head and the luminaire housing. Thus a two position rotation mechanism is desirable although not required.

FIG. 8 is a side view of right illumination head 120 showing features for cooperating with pivot barrel 180 and right housing component 132. Left illumination head 122 is a mirror image of right illumination head 120 and has similarly designated components. Illumination head 120 has an aperture for receiving pivot barrel 180 and lamp 121. The aperture is surrounded by a cylindrical extension 204 which has pivot guide 202 extending inward proximate the inner surface of illumination head 120 (see also FIG. 13). Cylindrical extension 206 concentrically surrounds cylindrical extension 204 and has a gap therebetween for receiving partial cylindrical extension 190 on right housing component 132. Threaded aperture 208 extends between cylindrical extensions 206 and 204 and has an outer wall therebetween for receiving fastener 151 to secure the head in position.

Figure 9:
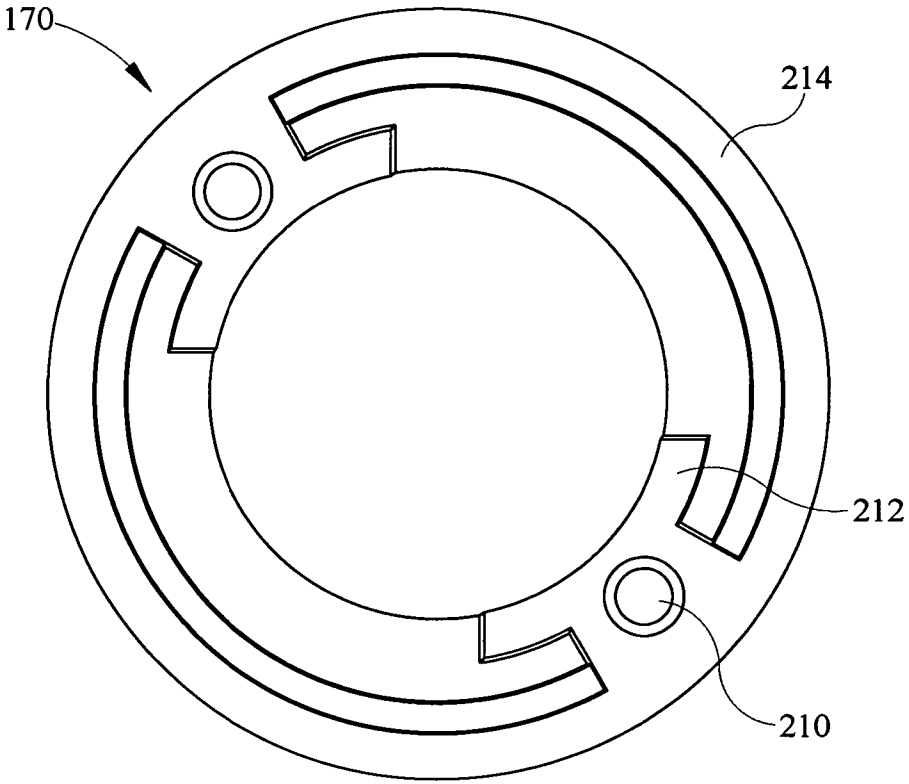
FIG. 9 is a front view of a pivot barrel of the luminaire of FIG. 1 showing features for cooperating with a housing.
Figure 10:
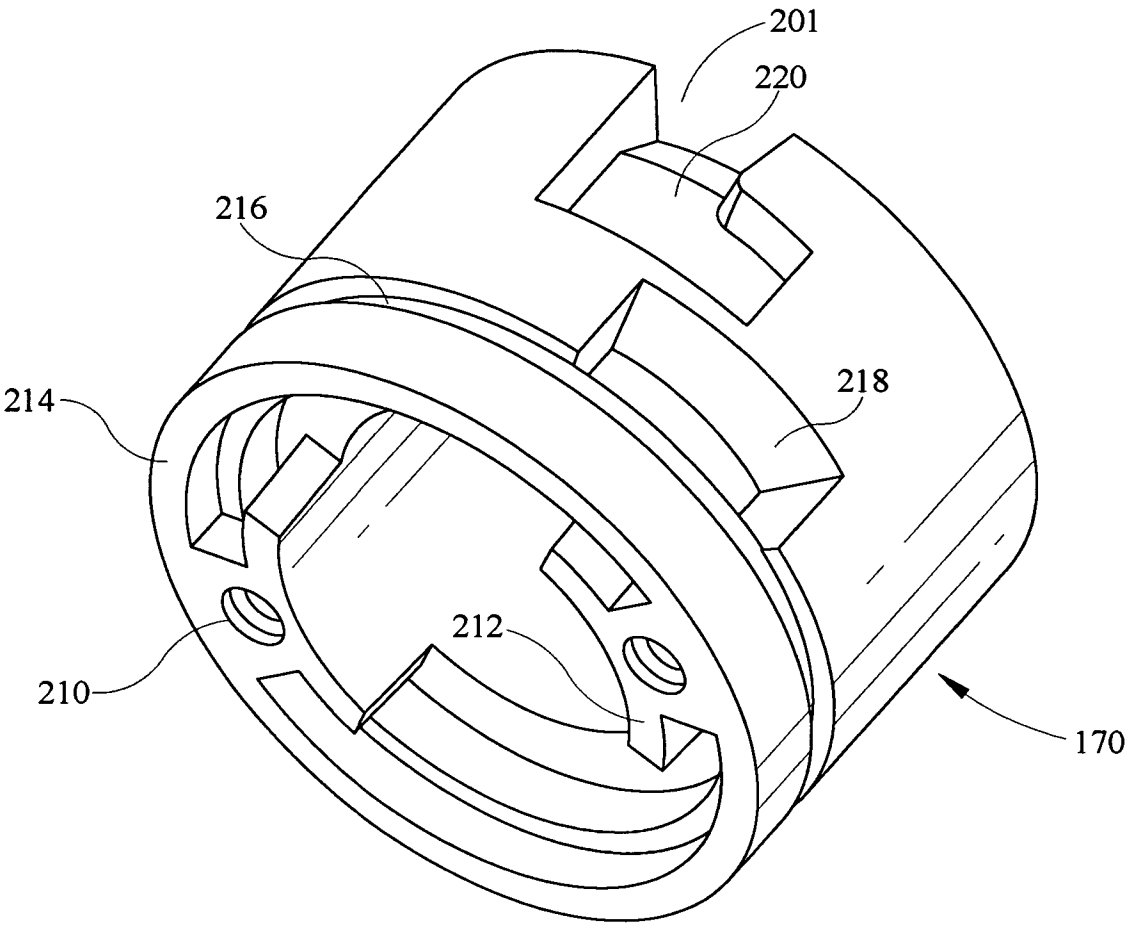
FIG. 10 is a perspective view of a pivot barrel of the luminaire of FIG. 1 showing features for cooperating with a housing and an illumination head.
Figure 11:
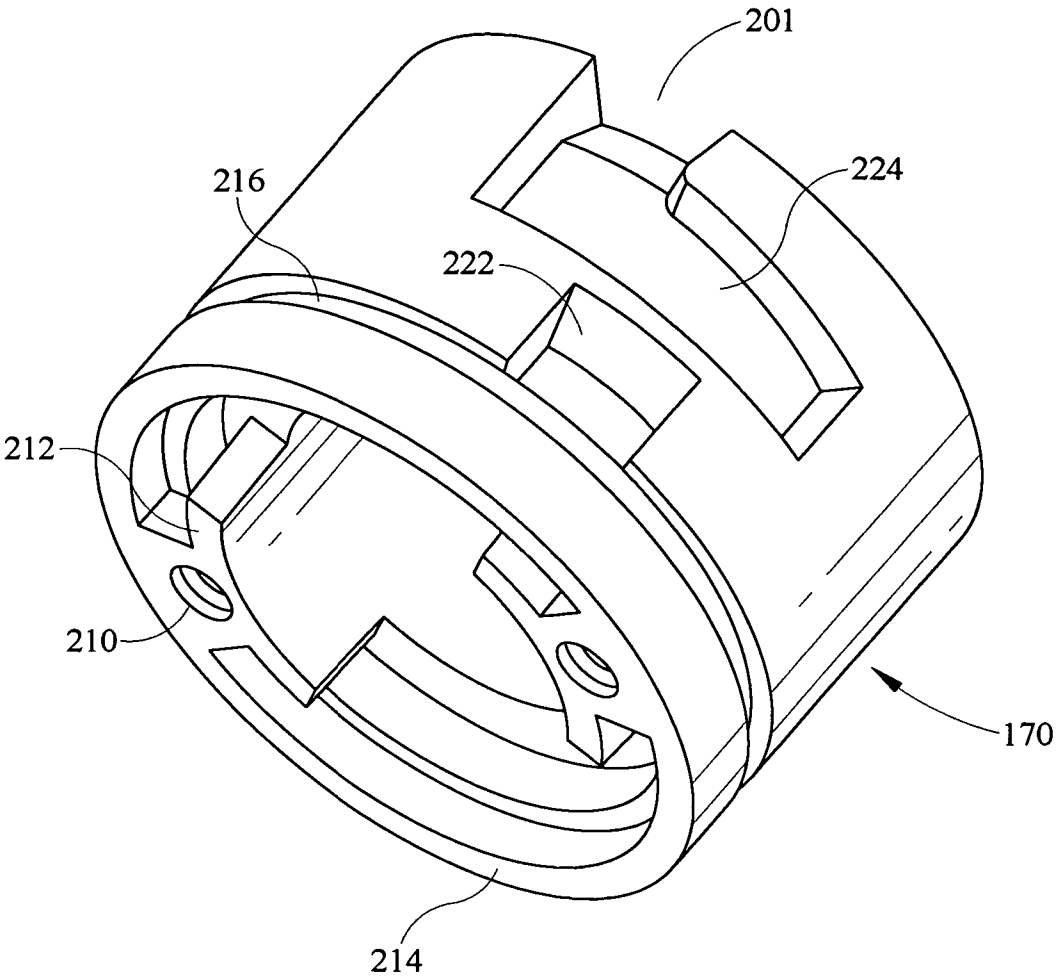
FIG. 11 is a perspective view of the pivot barrel of FIG. 10 showing it rotated 180° with features for rotatingly engaging an illumination head.

FIGS. 9-11 show different views of left pivot barrel 170. FIG. 9 shows an inner surface of pivot barrel 170 that cooperates with left housing component 122 at pivot barrel mounting surface 191 (FIG. 7). Wing projections 212 cooperate with the pair of equidistantly spaced depending partial cylindrical extensions 193 and threaded fastener receptacles 210 align with fastener receptacles 192 in housing component 130 wherein fasteners non-rotationally and removably attach pivot barrel 170 to housing component 130. Extending from the circumference of pivot barrel 170 is mounting surface 214 which mounts substantially flush with mounting surface 191 on housing component 130 (FIG. 7).

FIGS. 10 and 11 show side features of pivot barrel 170 for cooperating with illumination head 122. On the side, shown in FIG. 10, illumination head retaining groove 218, receiving a portion of fastener 151 (FIG. 8), and rotating pivot notch 220 are shown. On the opposite side, shown in FIG. 11, illumination head retaining groove 222, receiving a portion of fastener 151 (FIG. 8), and rotating pivot notch 224 are shown. Pivot notches 220 and 224 each extend on an outer surface to enable removal of the illumination heads 120 and 122 about a longitudinal axis of lamps 121 and 125 when rotated inward to −10° from vertical. When pivot barrel 170 is engaged with illumination head 122 so that pivot notch 220 rotatingly cooperates with pivot guide 202, only a −10° rotation of illumination head 122 is permitted about housing component 130 for removal since the arc length of pivot notch 220 and retaining groove 222 are relatively short and situated for downward orientation, $\alpha=0°$ (FIG. 3), and a reverse rotation of −10°, or inward rotation where $\alpha=-10°$ (FIG. 3), for removal of illumination head 122 for relamping. Rotating pivot barrel 170 180° and installing it onto illumination head 122 serves to align pivot notch 224 upwardly and retaining groove 218 downwardly with pivot notch guide 202 and threaded aperture 208, having fastener 151, respectively. In this configuration, an increased forward rotation of illumination head 122 about housing component 130 is permitted since the arc length of pivot notch 224 and retaining groove 118 are relatively long. Preferably, illumination head 122 can rotate outwardly about housing component 130 at least 30°, $\alpha=30°$ (FIG. 3), or even more, and inwardly at about −10° from vertical, aligning illumination head 122 for removal and relamping. Also shown in FIGS. 10 and 11 is gasket groove 216 which receives o-ring gasket 171 (FIG. 6) and cooperates with an inner surface of cylindrical extension 204 on illumination head 120.

Figure 12:
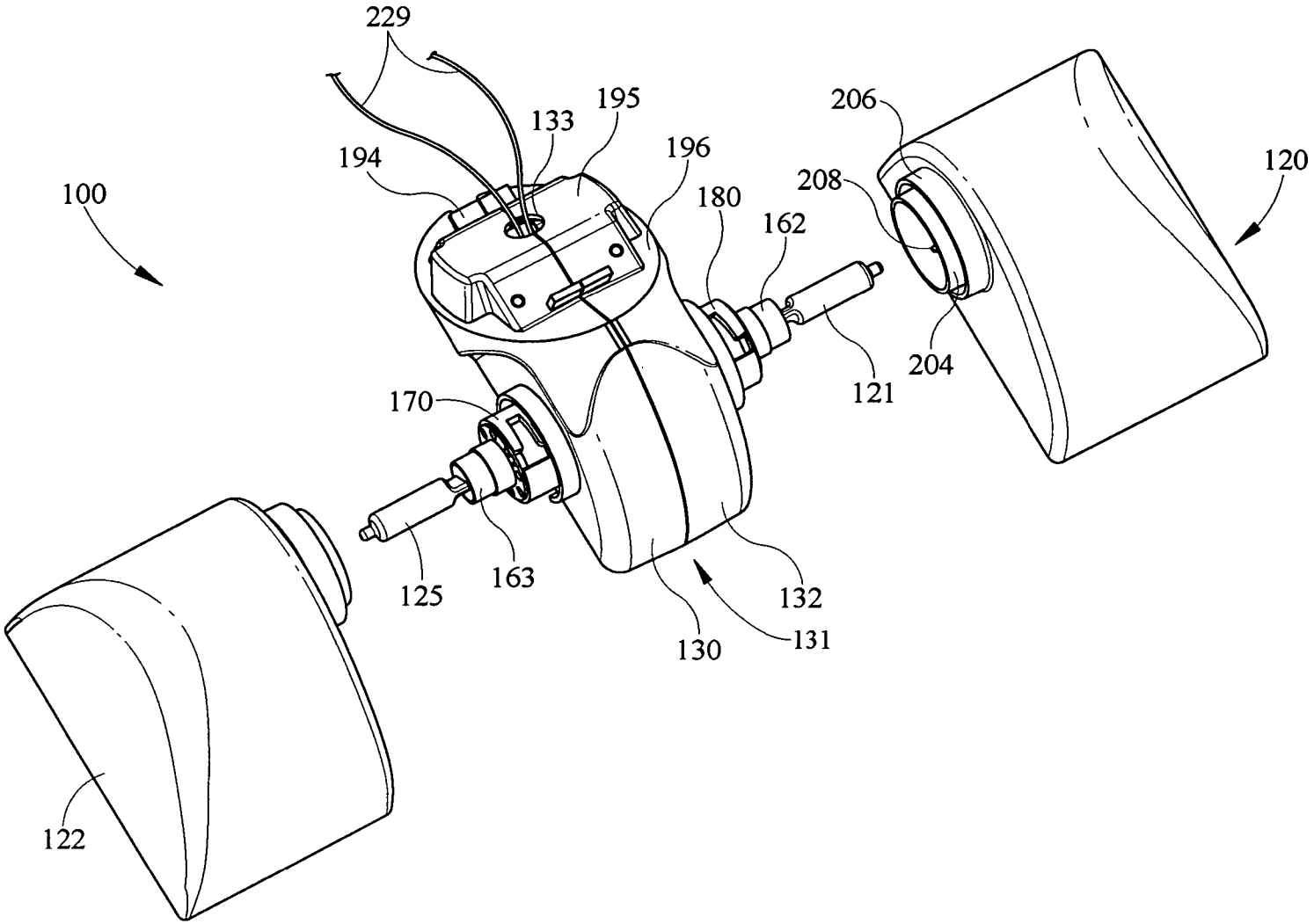
FIG. 12 is top perspective view of the luminaire of FIG. 1 showing a relamping feature.

FIG. 12 is top perspective view of the luminaire 100 showing it having illumination heads 120 and 122 removed for relamping. Right and left housing components 132 and 130 are joined forming a support housing 131 having side apertures wherein pivot barrels 180 and 170 are mounted. Extending from the housing through an aperture in each pivot barrel 180 and 170 are lamp sockets 162 and 163. Illumination heads 120 and 122 are removed for relamping by first retracting fasteners 151 in threaded apertures 208 in each illumination head 120 and 122 to a point where the head of the fastener no longer engages an illumination head retaining groove 218, 222 in pivot barrels 180 and 170. The illumination heads 120 and 122 are then rotated about pivot barrels 180 and 170, approximately −10°, aligning rotating pivot guides 202 with a portion of a pivot notch 201 axially extending to an edge thereof thus enabling the removal of the illumination heads 120 and 122 about a longitudinal axis of lamps 121 and 125. Lamps 121 and 125 are removed from lamp sockets 162 and 163 and replaced. Illumination heads 120 and 122 are then reattached to pivot barrels 180 and 170. Also shown here are electric wires 229 that extend through wiring aperture 133 into combined junction box mounting arm 110 for electrically connecting lamps 121 and 125 as well as sensor lens 150 to a power supply.

Figure 13:
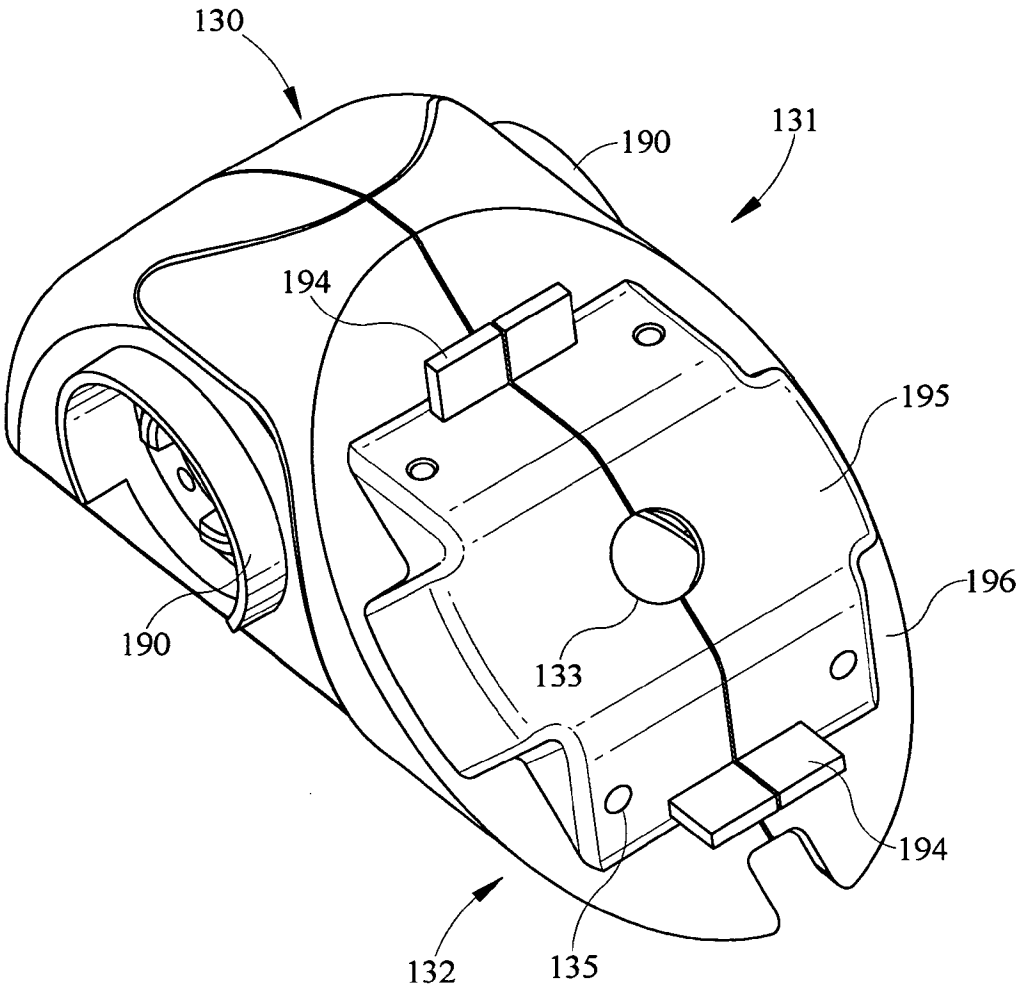
FIG. 13 is perspective view of the housing member of the luminaire of FIG. 1 showing a beveled mounting surface.

FIG. 13 is a view of a housing member 131 formed with housing components 130 and 132 showing rear angled or beveled mount surface 196 for engaging with beveled mounting face or angled mount surface 197 on arm mount 110. Rear beveled mount surface 196 has a bump out portion 195 for providing room within a housing for the containment of the wiring and electronics associated with sensor lens 150 and lamp sockets 162 and 163. Wiring aperture 133 is centrally oriented within bump out portion 195 providing for electronic access to components within the housing from junction box mount arm 110. Tabs 194 project from rear beveled mount surface 196 for engagement with an aligning tab in arm mount 110. One tab 194 engages an aligning tab in arm mount 110 when luminaire 100 is installed onto arm mount 110 for mounting on a vertical surface and the other tab 194 engages the aligning tab in arm mount 110 when luminaire 100 is installed onto arm mount 110 for mounting on a horizontal surface. Proximate corners of bump out portion 195 are threaded apertures 135 providing for a means for attachment of the housing to arm mount 110 via a pair of inwardly extending fastening tabs 113. Also shown here are outer partial cylindrical extensions 190 depending outwardly from each housing component 132 and 130.

Figure 14:
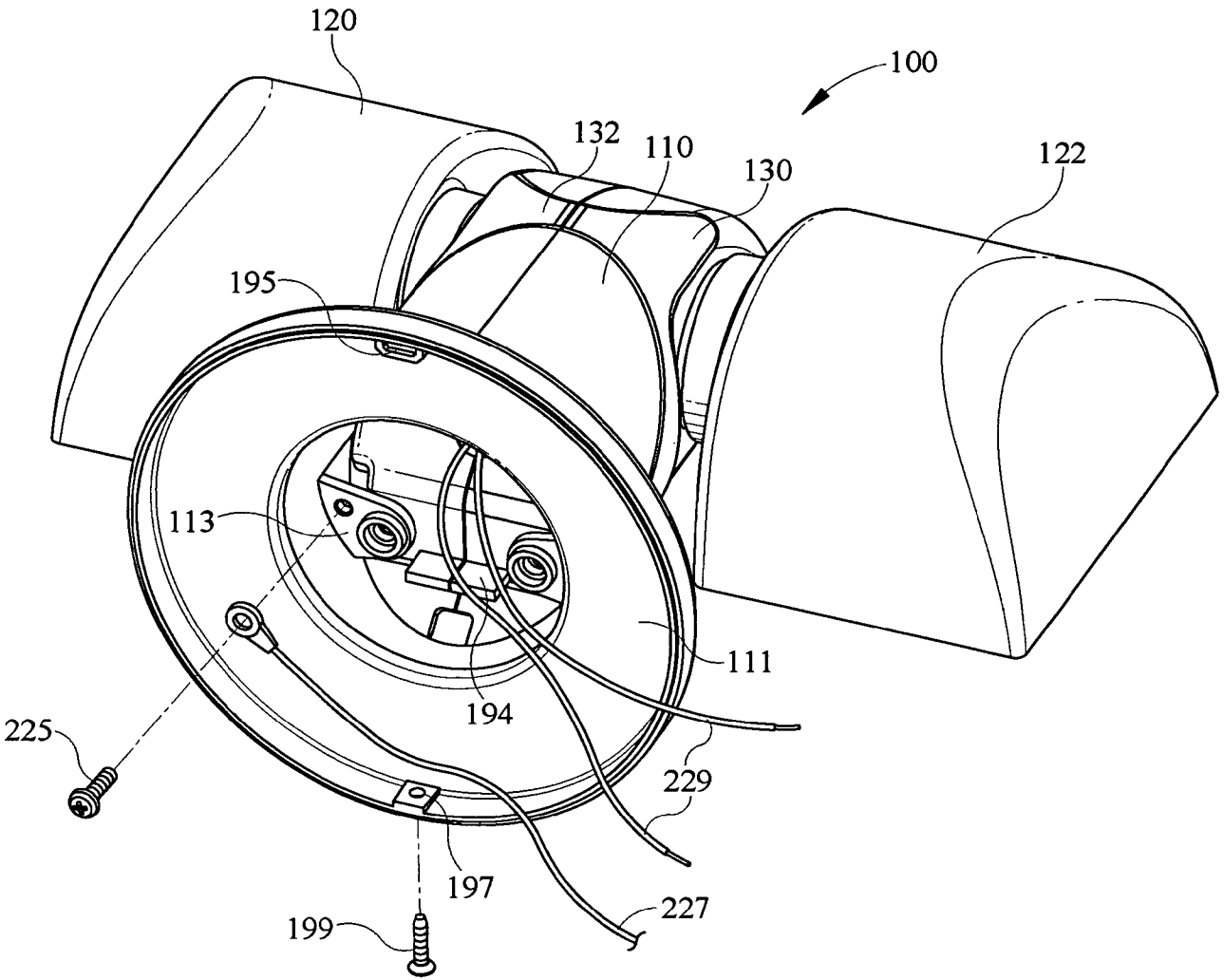
FIG. 14 is rear perspective view of the luminaire of FIG. 1 showing the internal side of a combination junction box and mounting arm.

FIG. 14 is rear perspective view of luminaire 100 engaged with combination mounting arm and junction box 110 showing the internal side thereof forming a junction box. Luminaire 100 is shown engaged with multiposition mounting arm 110 in a position for mounting on a vertical surface. Luminaire 100 has a right illumination head 120 and a left illumination head 122 engaged with a housing component 131. Mounting arm 110 is shown as having a hollow interior which forms a junction box between a flat mounting surface to which it is mounted and the support housing formed with housing components 132 and 130. Combined junction box mounting arm 110 has an outwardly radial extending mounting flange or surface mounting face 111 for receiving mounting plate 166 and mounting gasket 167 (shown in FIG. 6) which engages the mounting surface. Mounting gasket 167 covers a rear surface of mounting plate 166 (FIG. 6), both of which are fastened to a mounting surface and have aligning central apertures for receiving electrical wires. Mounting tab 195 is positioned about mounting flange 111 for installing mounting arm 110 on mounting plate 166. Mounting tab 195 depends inward from an upper surface of mounting flange 111 and engages a slot in the top of mounting plate 166. Aperture 197 receives fastener 199 for engaging a lower portion of mounting plate 166, securing mounting arm 110 onto mounting plate 166. The hollow interior of mounting arm junction box 110 is formed by a cylindrical or tubular mounting arm sidewall and is sufficient in size to act as a junction box to connect electrical wires 229 from luminaire 100, and other wires or electrical connections such as ground wire 227, to electrical power supply wires and other electrical connectors extending from the mounting surface into mounting arm junction box 110 through mounting plate 166. Depending inward from the sidewall of mounting arm 110 is a pair of inwardly extending fastening tabs 113 for removable affixation of luminaire 100 onto mounting arm 110. One fastening tab 113 has a threaded aperture for receiving fastener 225 for securing ground wire 227 thereto.

Generally described herein is a luminaire with either single or dual lamp heads, each of the lamp heads rotatably attached to a luminaire housing by a restricted rotational mechanism. This restricted rotation mechanism is interposed between the luminaire housing and the lamp head and generally imposes a rotational limitation on the lamp head. Presently, in one of the embodiments disclosed, the rotation mechanism is a pivot barrel that is rotatable into a first installed position and a second installed position, each mapping to a first restricted motion position for the lamp head. Alternative rotation mechanisms are also contemplated which perform the same or similar functions, such as knuckles, pivot pins or similar pivot mechanisms. Further, in one embodiment shown and described, the restricted rotation mechanism is a pivot barrel which is installable in a locked position within a side aperture of the luminaire housing. Each installed locked position represents a specific rotation capability for the lamp head, in one embodiment representing allowing installation of the lamp head at a −10 degrees relative to horizontal with counterclockwise rotation allowable to position the lamp head at about 0 degrees. Thus, the pivot barrel has a rotation limitation structure which allows minimal, about 10 degrees, rotation of the lamp head. In the second installed position, the restricted rotation mechanism of the present embodiment may allow further rotation beyond 0 degrees relative to horizontal. In one embodiment the length of channels formed on either side of the pivot mechanism determines the length of allowable rotation. Still further, one embodiment details additional structures which perform similar rotation functions. Additionally, in the embodiments shown, a junction box mounting arm is mountable directly against the luminaire, and preferably against a mounting surface, which allows installation against either a horizontal or a vertical surface while maintaining lamp head position relative to the ground. Such mounting arms described may also provide an interior which acts to allow space for junction box function. The mounting arm has a beveled surface in one embodiment which acts to engage a similar mounting surface on the luminaire. Alternative structures, as clearly shown herein, may provide similar functional mounting surfaces and structures. While the present invention has been shown and described herein in what are considered to be embodiments thereof, the invention is not limited to those specific embodiments. Thus, the forms of the invention shown and described herein are to be taken as illustrative only and other embodiments may be selected without departing from the scope of the present invention, as set forth in the claims appended hereto.

We claim:

1. A lamp head rotation mechanism for a luminaire comprising:

a housing having at least one pivot barrel depending therefrom;

an illumination head rotatingly attached to each of said at least one pivot barrel;

each of said illumination heads having an aperture with a radially depending pivot guide for rotatingly receiving said pivot barrel;

each of said at least one pivot barrel having a first pivot notch and a second pivot notch in a sidewall thereof for receiving said pivot guide and rotation of said illumination head about said housing;

said first pivot notch having an arc length about said pivot barrel sufficient to allow at least a 10° rearward rotation of said illumination head about said housing, wherein the at least one pivot barrel is cylindrical having an outer surface and an inner surface, wherein the outer surface has the first pivot notch and the second pivot notch, and wherein the inner surface includes a tab extending into the inner surface and having wing projections parallel to the inner surface for insertion into alignment holes of the housing.

2. The lamp head rotation mechanism for a luminaire of claim 1, wherein said second pivot notch has an arc length about said pivot barrel sufficient to allow at least a 30° forward rotation of said illumination head about said housing.

3. The lamp head rotation mechanism for a luminaire of claim 1, wherein at least one of said first pivot notch and said second pivot notch has an arc length about said pivot barrel sufficient to prohibit forward rotation of said illumination head about said housing in excess of about 0° with respect to an area being illuminated.

4. The lamp head rotation mechanism of claim 1, wherein said first pivot notch is perpendicular to and shorter than said second pivot notch.

5. The lamp head rotation mechanism of claim 1, wherein the tab includes a threaded receptacle aligned with fastener receptacles in the housing for receiving a fastener to non-rotationally and removably attach the at least one pivot barrel to the housing.

6. A rotation mechanism for respositionable lamp heads, comprising:

a luminaire body having a mounting surface;

a mount removably attachable to said luminaire body on said mounting surface and mountable to one of a horizontal or a vertical surface;

a first lamp head and a second lamp head restrictably rotatable relative to said luminaire body, each of said lamp heads being rotatable to a cut-off position and to a forward throw position;

wherein said restrictable rotation is provided by a re-positionable pivoting connection between each of said lamp heads and said luminaire body preventing forward rotation and throw of light when set at said cut-off position and restricting forward rotation of said lamp heads when set at said forward throw position, wherein said re-positionable pivoting connection is a pivot barrel, wherein said pivot barrel has a first rotation channel and a second rotation channel engageable with a pivot guide on said lamp head for rotation of one of said lamp heads about said luminaire body, and wherein the pivot barrel is cylindrical having an outer surface and an inner surface, wherein the outer surface has the first rotation channel and the second rotation channel, wherein the inner surface includes a tab extending into the inner surface and having wing projections parallel to the inner surface for insertion into alignment holes of the luminaire body, and wherein the tab includes a threaded receptacle aligned with fastener receptacles in the luminaire body for receiving a fastener to non-rotationally and removably attach the pivot barrel to the luminaire body.

7. The rotation mechanism for luminaire of claim 6, wherein said pivot barrel is installed in a first upright position and rotatable and installable in a second oriented position.

8. The lamp head rotation mechanism of claim 6, wherein said first rotation channel is perpendicular to and shorter than said second rotation channel.

9. A dual lamp luminaire having a rotational connection between a luminaire body and a lamp, comprising:

a first lamp head and a second lamp head;

the luminaire body rotatably connected to the first lamp head and the second lamp head, said luminaire body having an angled mounting surface removably engageable with a support arm, said support arm mountable against a horizontal surface or a vertical surface;

each of said rotatable connection having a first orientation restricting forward rotation of said lamp head to about 0 degrees, and a second orientation allowing forward rotation to about 30 degrees;

said rotatable connection being a respositionable rotation assembly installable in a first orientation and a second orientation between said lamp head and said luminaire body, wherein each of said rotatable connection is a cylindrical pivot barrel installed in said luminaire body and engageable with a pivot tab on said lamp head, wherein said cylindrical pivot barrel has a first rotation channel and a second rotation channel engageable with the pivot guide for rotation of one of said lamp heads about said luminaire body, and wherein the cylindrical pivot barrel has an outer surface and an inner surface, wherein the outer surface has the first rotation channel and the second rotation channel, wherein the inner surface includes a tab extending into the inner surface and having wing projections parallel to the inner surface for insertion into alignment holes of the luminaire body, and wherein the tab includes a threaded receptacle aligned with fastener receptacles in the luminaire body for receiving a fastener to non-rotationally and removably attach the cylindrical pivot barrel to the luminaire body.

10. The dual lamp luminaire of claim 9, wherein said first rotation channel is perpendicular to and shorter than said second rotation channel.

11. A rotational pivot connection between a lamp head and a luminaire housing, comprising:

a luminaire housing having an aperture for receiving a pivot barrel;

said pivot barrel having a first slot and a second slot, said first and said second slots being constructed to receive a pivot guide in a lamp head aperture;

said pivot barrel repositionable within said luminaire housing aperture such that either said first slot or said second slot is engaged by said pivot guide of said lamp head aperture for rotation of said lamp head about said luminaire housing, wherein the pivot barrel is cylindrical having an outer surface and an inner surface, wherein the outer surface has the first slot and the second slot, wherein the inner surface includes a tab extending into the inner surface and having wing projections parallel to the inner surface for insertion into alignment holes of the luminaire housing, and wherein the tab includes a threaded receptacle aligned with fastener receptacles in the luminaire housing for receiving a fastener to non-rotationally and removably attach the pivot barrel to the luminaire housing.

12. The rotational pivot guide of claim 11 wherein said pivot barrel is repositioned by rotating said pivot barrel within said luminaire housing aperture into a first position or a second position.

13. The rotational pivot connection of claim 12 wherein said pivot barrel has at least one alignment projection to properly align said pivot barrel within said aperture of said luminaire housing.

14. The rotational pivot connection of claim 13, wherein said pivot barrel has a first alignment projection and a second alignment projection which abut a first cylindrical projection and a second cylindrical projection on said luminaire housing aperture to position said pivot barrel.

15. The rotational pivot connection of claim 13, wherein said rotational position allows said lamp head to be installed axially on said pivot barrel at an angle relative to the ground, said angle being less than about 0°.

16. The rotational pivot connection of claim 12 wherein said first slot positions said lamp head at about 0° maximum rotation.

17. The rotational pivot connection of claim 12 wherein said second slot allows said lamp housing to rotate up to about 30° maximum rotation.

18. The rotational pivot connection of claim 12, wherein said pivot barrel has a first lamp and a second lamp head position locking groove, said first locking groove separated from said second locking groove about 180°, said first locking groove positioned adjacent to a locking aperture adjacent said lamp head aperture when said second slot of said pivot barrel is engaged by said pivot guide.

19. The rotational pivot connection of claim 11, wherein said second slot of said pivot barrel allows said lamp head to rotate about 0° relative to the ground, said first slot having an end abutment, said pivot guide contacting said end abutment when said lamp head is at about 0°.

20. The rotational pivot connection of claim 11, wherein said first slot is perpendicular to and shorter than said second slot.

* * * * *